United States Patent [19]

Nishida et al.

[11] Patent Number: 4,846,640

[45] Date of Patent: Jul. 11, 1989

[54] SCROLL-TYPE VACUUM APPARATUS WITH ROTATING SCROLLS AND DISCHARGE VALVE

[75] Inventors: Mitsuhiro Nishida; Isamu Etou, both of Fukuoka City; Etsuo Morishita, Amagasaki City, all of Japan

[73] Assignee: Mitsubishi Denki Kabushiki Kaisha, Japan

[21] Appl. No.: 98,961

[22] Filed: Sep. 21, 1987

[30] Foreign Application Priority Data

| | | | |
|---|---|---|---|
| Sep. 24, 1986 | [JP] | Japan | 61-226976 |
| Mar. 31, 1987 | [JP] | Japan | 62-79901 |
| Jul. 16, 1987 | [JP] | Japan | 62-179357 |

[51] Int. Cl.[4] ..... F04C 18/04; F04C 27/02

[52] U.S. Cl. ..... 418/55; 418/94; 418/185; 418/188

[58] Field of Search ..... 418/55, 59, 94, 97–100, 418/188, DIG. 1, 185

[56] References Cited

U.S. PATENT DOCUMENTS

| | | | |
|---|---|---|---|
| 3,600,114 | 8/1971 | Dvorak et al. | 418/55 |
| 3,884,599 | 5/1975 | Young et al. | 418/55 |
| 4,655,697 | 4/1987 | Nakamura et al. | 418/55 |
| 4,735,559 | 4/1988 | Morishita et al. | 418/188 |

FOREIGN PATENT DOCUMENTS

| | | | |
|---|---|---|---|
| 57-68579 | 4/1982 | Japan | 418/55 |
| 58-15787 | 1/1983 | Japan | 418/94 |
| 60-38919 | 3/1985 | Japan . | |
| 60-145483 | 7/1985 | Japan | 418/55 |
| 61-40483 | 2/1986 | Japan | 418/55 |

*Primary Examiner*—John J. Vrablik

*Attorney, Agent, or Firm*—Leydig, Voit & Mayer

[57] ABSTRACT

A scroll type positive displacement apparatus which can be used as a vacuum pump is disclosed. A pair of interfitting scrolls are housed in a first container which communicates with a vacuum chamber to be evacuated by the pump. The scrolls are rotated in synchrony about parallel, nonaligned axes by a drive motor. The scrolls define a plurality of spiral compression chambers which change in size when the scrolls are rotated, compressing a gas contained in the compression chambers. The shaft of one of the scrolls has a discharge port formed therein which communicates between the centermost compression chamber and the inside of a second container which adjoins the first container. The second container is partially filled with lubricating oil and communicates with the atmosphere. The discharge port is equipped with a check valve which permits compressed gas to enter the second container from the scrolls but prevents gas from flowing in the opposite direction. The pump may be further equipped with one or more oil supply passageways formed in the shaft of the scroll in which the discharge port is formed. Lubricating oil is introduced via the oil supply passageway from the second container into one or more of the compression chambers of the pump.

10 Claims, 9 Drawing Sheets

FIG.3(a)
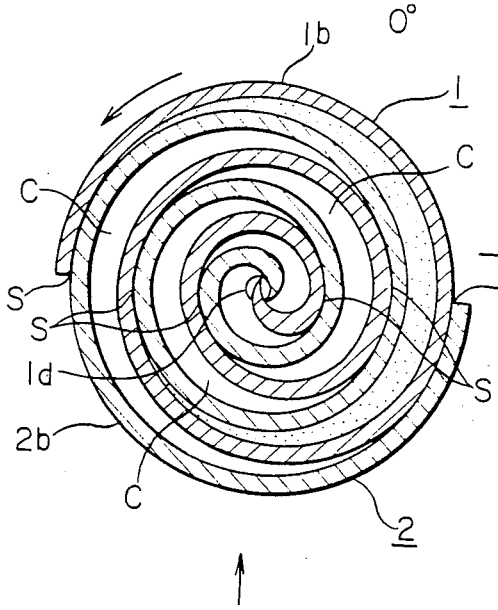
FIG.3(b)
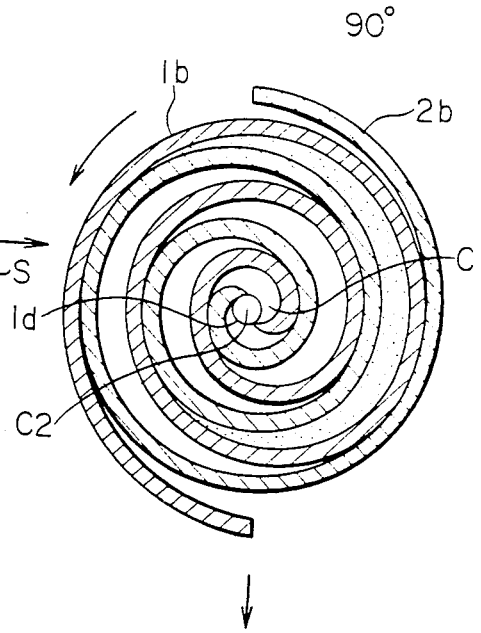
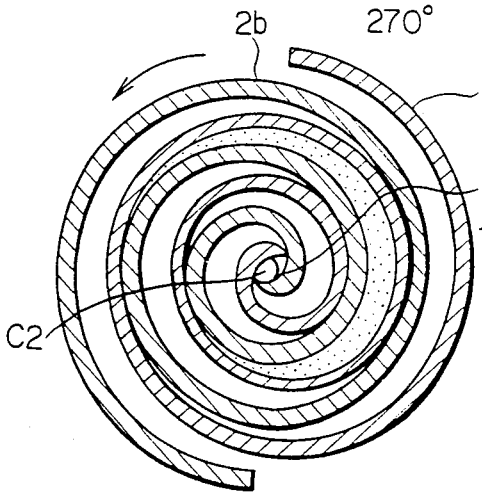
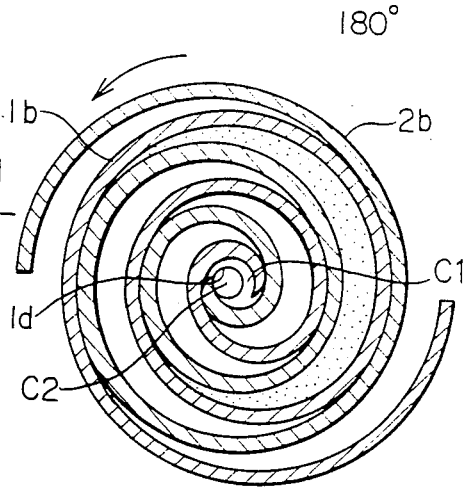
FIG.3(d)
FIG.3(c)

SCROLL-TYPE VACUUM APPARATUS WITH ROTATING SCROLLS AND DISCHARGE VALVE

BACKGROUND OF THE INVENTION

This invention relates to a scroll-type positive displacement apparatus, and more particularly to a scroll-type positive displacement apparatus which can be employed as a vacuum pump.

A scroll-type positive displacement apparatus (hereinunder referred to simply as a scroll-type pump) is a form of rotary pump in which the suction and compression chambers of the pump are defined by two interfitting scroll-shaped members, which are commonly referred to simply as scrolls. Generally, each scroll comprises a flat end plate and a spiral wall (commonly referred to as a wrap) which extends perpendicularly from the end plate. The two scrolls are disposed with their end plates parallel to one another and the spiral wraps interfitted so that the surfaces of the end plates and the spiral wraps define a plurality of spiral chambers, which serve as compression chambers and suction chambers. When the scrolls are rotated with respect to one another, the volumes of these chambers continuously vary and fluid, which is introduced into the chambers, is transported either towards or away from the centers of the scrolls, depending on the direction of rotation. If the fluid is transported towards the center, it is compressed, while if it is transported away from the center, it is expanded.

Scroll-type pumps can be divided into two large classes. In one class of scroll-type pump, one of the scrolls is maintained stationary while the other scroll is orbitted about the center of the stationary scroll while being restrained from rotating on its own axis. In the other class of scroll-type pump, both of the scrolls rotate on parallel, nonaligned axes. With the first class of pump, it is necessary to provide counterweights to balance the moving scroll as it orbits. In the second class, however, each scroll undergoes balanced rotation on its own axis, so no counterweights are needed, and higher rotational speeds and higher pump capacities can be achieved.

The biggest problem which is encountered with scroll-type pumps is leaks between adjoining compression chambers. On account of the complicated shape of the spiral wraps of the scrolls, it is extremely difficult to maintain a high pressure differential between the suction and discharge sides of such a pump. Therefore, while there are a number of applications for which scroll-type pumps are suitable, it has not yet been possible to use them as vacuum pumps.

SUMMARY OF THE INVENTION

Accordingly, it is an object of the present invention to provide a scroll-type pump which can be used as a vacuum pump.

A scroll-type vacuum pump in accordance with the present invention is of the type having a first scroll and a second scroll which are rotated in synchrony about parallel, nonaligned axes. Each scroll comprises an end plate, a sprial wrap which extends perpendicularly from one side of the end plate, and a shaft which extends perpendicularly from the other side of the end plate. The scrolls are interfitted so as to form a plurality of spiral compression chambers which change in size as the scrolls are rotated. Both scrolls are disposed in a first container which communicates with a vacuum chamber which is to be evacuated. A discharge port is formed in the center of the end plate of the first scroll. One end of the discharge port opens onto the centermost of the compression chambers defined by the scrolls, and the other end communicates with a discharge passageway which is formed in the shaft of the first scroll and which opens onto the inside of a second container. The second container is partially filled with lubricating oil and communicates with the atmosphere. The discharge port is equipped with valve means which allows gas to be discharged from the scrolls through the discharge port but prevents gas from flowing in the reverse direction through the discharge port.

Any suitable drive means can be used to rotate the two scrolls in synchrony about their respective axes, but in preferred embodiments, the first scroll is a drive scroll which is rotated by an electric motor, and the second scroll is a driven scroll which is rotated by the drive scroll through a coupling.

The valve means can be a conventional check valve which is disposed in the discharge port or along the discharge passageway. A single check valve may be used, or a plurality may be disposed in series in the discharge port and the discharge passageway.

The shaft of the first scroll may have any oil supply passageway formed therein for supplying lubricating oil from the inside of the second container to the inside of one of the compression chambers formed by the scrolls. The lubricating oil increases the vacuum produced by the pump by sealing gaps between the scrolls and by absorbing residual gas in the compression chambers. In one preferred embodiment, a single oil supply passageway is formed in the shaft of the first scroll. It opens onto a compression chamber in the vicinity of the discharge port. In another preferred embodiment, a plurality of oil supply passageways are formed in the shaft of the first scroll. The passageways are symmetrically disposed with respect to the center of the shaft and open onto a plurality of compression chambers.

When the shaft of the first scroll is provided with an oil supply passageway which opens onto the centermost of the compression chambers, the cross-sectional area of the oil supply passageway is preferably such that the volume of oil which passes through the oil supply passageway per revolution of the pump is equal to the volume of the centermost compression chamber. When this relationship is satisfied, the vacuum which is produced by the pump is a maximum.

BRIEF DESCRIPTION OF THE DRAWINGS

FIG. 3*a*–3*d* are horizontal cross-sectional views of the spiral wraps of the scrolls of FIG. 1 at four different rotational positions.

In the figures, the same reference numerals indicate the same or corresponding parts.

DESCRIPTION OF THE PREFERRED EMBODIMENTS

Figure 1:
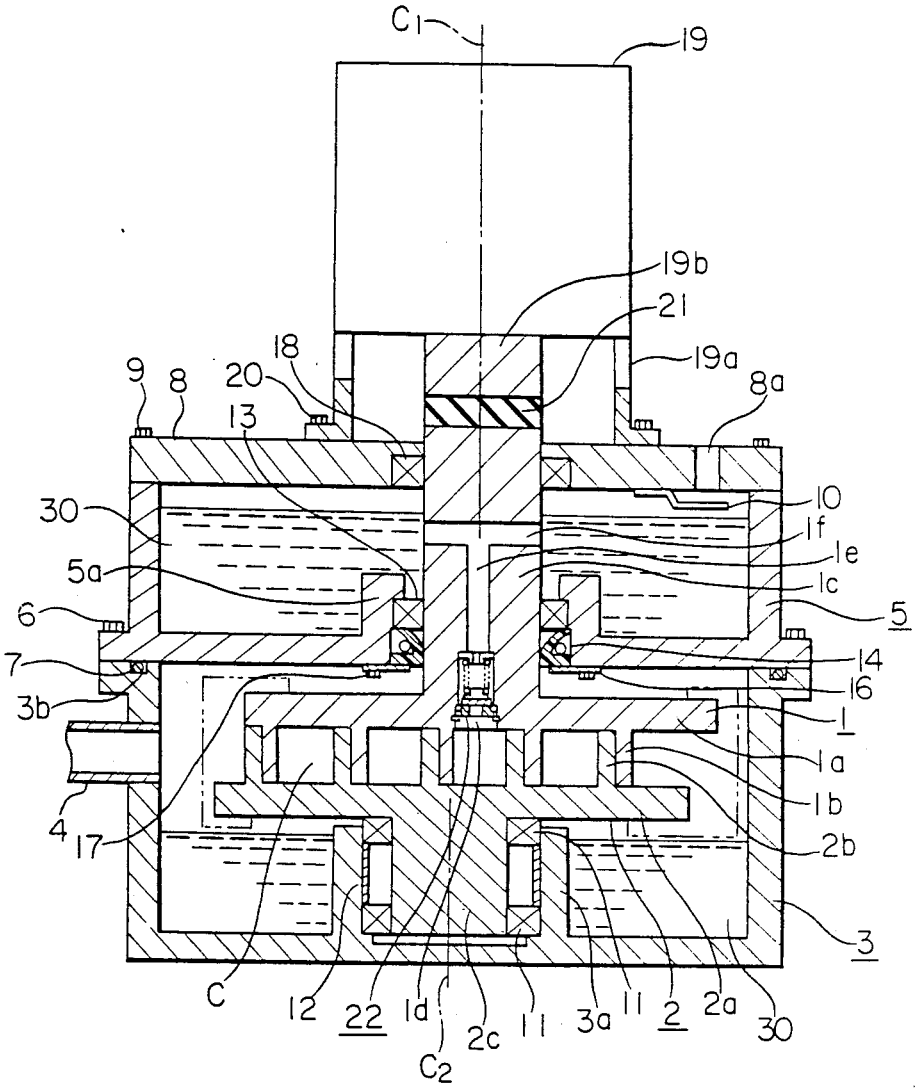
FIG. 1 is a vertical cross-sectional view of a first embodiment of a scroll-type vacuum pump in accordance with the present invention.

Hereinbelow, a number of preferred embodiments of a scroll-type vacuum pump in accordance with the present invention will be described while referring to the accompanying drawings, FIG. 1 of which is a vertical cross-sectional view of a first embodiment. As shown in this figure, a drive scroll 1 and a driven scroll 2 are housed in a cylindrical lower container 3. The drive scroll 1 has a flat, disk-shaped end plate 1*a* and a spiral wrap 1*b* which extends perpendicularly from one surface of the end plate 1*a*. A drive shaft 1*c* having a rotational axis C1 extends perpendicularly from the center of the other surface of the end plate 1*a*. An axially-extending discharge passageway 1*e* is formed at the center of the drive shaft 1*c*. The upper end of the axial discharge passageway 1*e* communicates with the outside of the drive shaft 1*c* via a plurality of radially-extending discharge passageways 1*f* which are formed in the drive shaft 1*c*. The lower end of the axial discharge passageway 1*e* connects to a discharge port 1*d* which opens onto the lower surface of the end plate 1*a* at its center.

Similarly, the driven scroll 2 has a flat, disk-shaped end plate 2*a* and a spiral wrap 2*b* which extends perpendicularly from one surface of the end plate 2*a*. The spiral wrap 2*b* has the same pitch as the sprial wrap 1*b* of the drive scroll 1. A short shaft 2*c* extends perpendicularly from the other side of the end plate 2*a*. The rotational axis C2 of the shaft 2*c* is parallel to but nonaligned with the rotational axis C1 of the drive scroll 1.

A suction port 4 pierces the wall of the lower container 3 and opens onto the inside thereof. The suction port 4 is connected by unillustrated piping to an unillustrated vacuum chamber which is to be evacuated by the pump. Accordingly, the inside of the lower container 3 is at the same pressure as the vacuum chamber. The lower container 3 is partially filled with lubricating oil 30.

A cylindrical bearing housing 3*a* is formed on the bottom surface of the lower container 3 and extends perpendicularly upwards therefrom. It houses two bearings 11 which journal the shaft 2*c* of the driven scroll 2. The bearings 11 are separated from one another by a cylindrical bearing spacer 12.

The open upper end of the lower container 3 is covered by the bottom of a cylindrical upper container 5 which is secured to the lower container 3 by bolts 6. The joint between the two containers is sealed by an O-ring 7 which fits into an annular groove 3*b* formed in the upper surface of the lower container 3. The bottom portion of the upper housing 5 has a hole formed in its center, and this hole is surrounded by a cylindrical bearing housing 5*a* which is integral with the bottom surface of the upper container 5. The drive shaft 1*c* of the drive scroll 1 extends through the bearing housing 5*a* into the upper container 5 and is journalled by a bearing 13 which is disposed inside the bearing housing 5*a*. A spring-loaded packing 14 is disposed beneath the bearing 13 and is supported from below by an annular restraining plate 16. The restraining plate 16 surrounds the drive shaft 1*c* and is secured to the undersurface of the upper container 5 by bolts 17. The packing 14 prevents fluids and gases from leaking into the lower container 3 along the outside of the drive shaft 1*c*. The upper container 5 is partially filled with lubricating oil 30 to a level above the radial discharge passageways 1*f*.

The open upper end of the upper container 5 is covered by an annular cover plate 8 which is secured to the upper housing 5 by bolts 9. A through hole which serves as an exhaust port 8*a* is formed in the cover plate 8. The inside of the upper container 5 communicates with the atmosphere through the exhaust port 8*a*. An oil baffle 10 for catching lubricating oil is secured to the underside of the cover plate 8 and extends in front of the inner end of the exhaust port 8*a*. The hole at the center of the cover plate 8 supports a bearing 18, and the upper end of the drive shaft 1*c* is journalled by this bearing 18.

the frame 19*a* of an electric motor 19 is secured to the upper surface of the cover plate 8 by bolts 20. The motor 19 has a rotating output shaft 19*b* which is coaxial with respect to the drive shaft 1*c* and is rigidly connected thereto by a coupling 21. The drive scroll 1 is thus rotated directly by the electric motor 19. The rotation of the drive scroll 1 is transmitted to the driven scroll 2 by an unillustrated coupling so that the drive scroll 1 and the driven scroll 2 rotate in synchrony about their respective axes.

Figure 2:
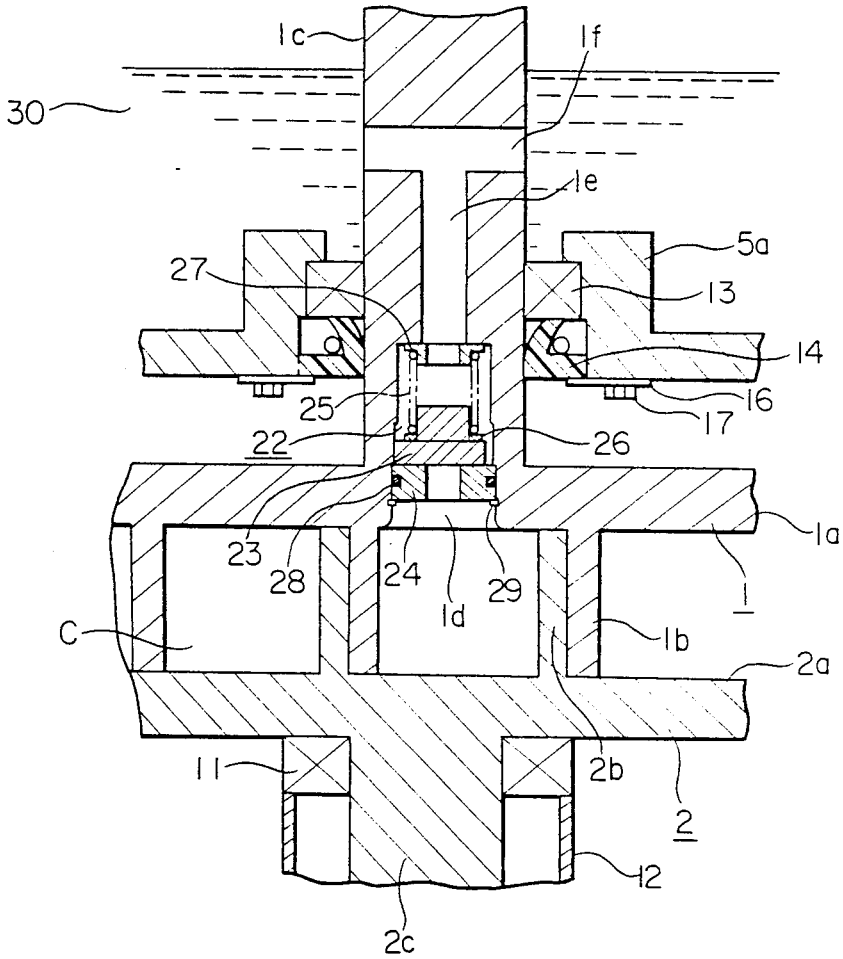
FIG. 2 is an enlarged view of the central portion of FIG. 1.

As shown more clearly in FIG. 2, which is an enlarged view of the central portion of FIG. 1, a spring-loaded check valve 22 is disposed inside the discharge port 1*d* of the drive scroll 1. The check valve 22 has a hat-shaped slider 23 which can reciprocate inside the discharge port 1*d* towards and away from an annular valve seat 24 which is disposed near the mouth of the discharge port 1*d*. The slider 23 is biased towards the valve seat 24 by a compression spring 25. The lower end of the spring 25 fits over the upper portion of the slider 23 and rests atop a washer 26, while the upper end of the spring 25 fits over a hollow spring guide 27 which is secured to the top of the inner surface of the discharge port 1*d* at the entrance to the axial discharge passageway 1*e*. An O-ring 28 for forming an airtight seal is housed inside a ring groove formed in the outer surface of the valve seat 24. The valve seat 24 is held in place from below by a snap ring 29.

FIGS. 3*a*–3*d* are horizontal cross-sectional views of the spiral wraps 1*b* and 2*b* of FIG. 1 at four different rotational positions during a single rotation of the drive scroll 1 and the driven scroll 2. The two spiral wraps are in tangential contact with one another at a plurality of locations S. These locations S are always stationary and lie in a single plane which passes through the center of rotation C1 of the drive scroll 1 and the center of rotation C2 of the driven scroll 2. The spiral wraps define a plurality of spiral compression chambers C between the points of contact. FIG. 3*a* shows the two scrolls at a rotational position, arbitrarily referred to as 0 degrees, at which the outermost end of the spiral wrap of each scroll has momentarily come into contact with the outer surface of the spiral wrap of the other scroll so as to enclose two pockets of gas, one of which is shown by the dots in the figure. In this position, six separate pockets of gas exist in the different compression chambers C defined by the spiral wraps.

FIG. 3*b* shows the state at which both scrolls have been rotated counterclockwise about their respective rotational centers by 90 degrees from the position shown in FIG. 3*a*. The pocket of fluid has been moved towards the centers of the scrolls, as a result of which its volume has decreased.

FIGS. 3*c* and 3*d* shows the states after which both scrolls have been rotated counterclockwise by 180 and 270 degrees, respectively, from the state shown in FIG. 3*a*. If the scrolls are rotated counterclockwise by an additional 90 degrees, they will again appear as shown in FIG. 3*a*. At each position, the pocket of gas is moved still closer to the discharge port 1*d* and is reduced in volume. After another two complete rotations from the state shown in FIG. 3*d*, the pocket of gas will have been moved to the center of the drive scroll 1 and discharged from the discharge port 1*d*.

When the electric motor 19 is operated, the drive scroll 1 and the driven scroll 2 are continuously rotated in this manner about their respective axes. Thus, gas is continuously sucked from the unillustrated vacuum chamber, compressed by the scrolls, and discharged through the discharge port 1*d*.

In addition to lubricating the lower bearings 11, the lubricating oil 30 which partially fills the lower container 3 forms a film between the end plates of the scrolls and the end surfaces of the spiral wraps which the end plates confront. Namely, lubricating oil 30 from the lower container 3 is entrained in the form of a mist in the suction gas which is drawn into the compression chambers C, and a portion of the entrained mist adheres to the end plates and spiral wraps of the scrolls to form a lubricating oil film. This oil film functions as a seal and helps to prevent the gas which is compressed by the scrolls from leaking in the radial direction between adjacent compression chambers C. The oil 30 also forms a seal along the points of contacts S where the spiral wraps contact one another and helps to prevent the compressed gas from leaking in the circumferential direction between adjacent compression chambers C.

When compressed gas reaches the discharge port 1*d*, it pushes up the slider 23 of the check valve 22 and flows into the upper container 5 via the axial discharge passageway 1*e* and the radial discharge passageways 1*f*. In pushing open the check valve 22, the compressed gas is aided by the incompressibility of the lubricating oil which is entrained in it. This discharged gas then flows out of the upper container 5, which has a large volume, into the atmosphere via the exhaust port 8*a*. Oil 30 which is entrained in the discharged gas is separated from the gas by the baffle 10 and accumulates inside the upper container 5, where it lubricates bearing 13 for the drive shaft 1*c*. The check valve 22 prevents discharged gas from flowing back into the compression chambers C and thereby increases the vacuum which can be achieved by the pump.

Figure 4:
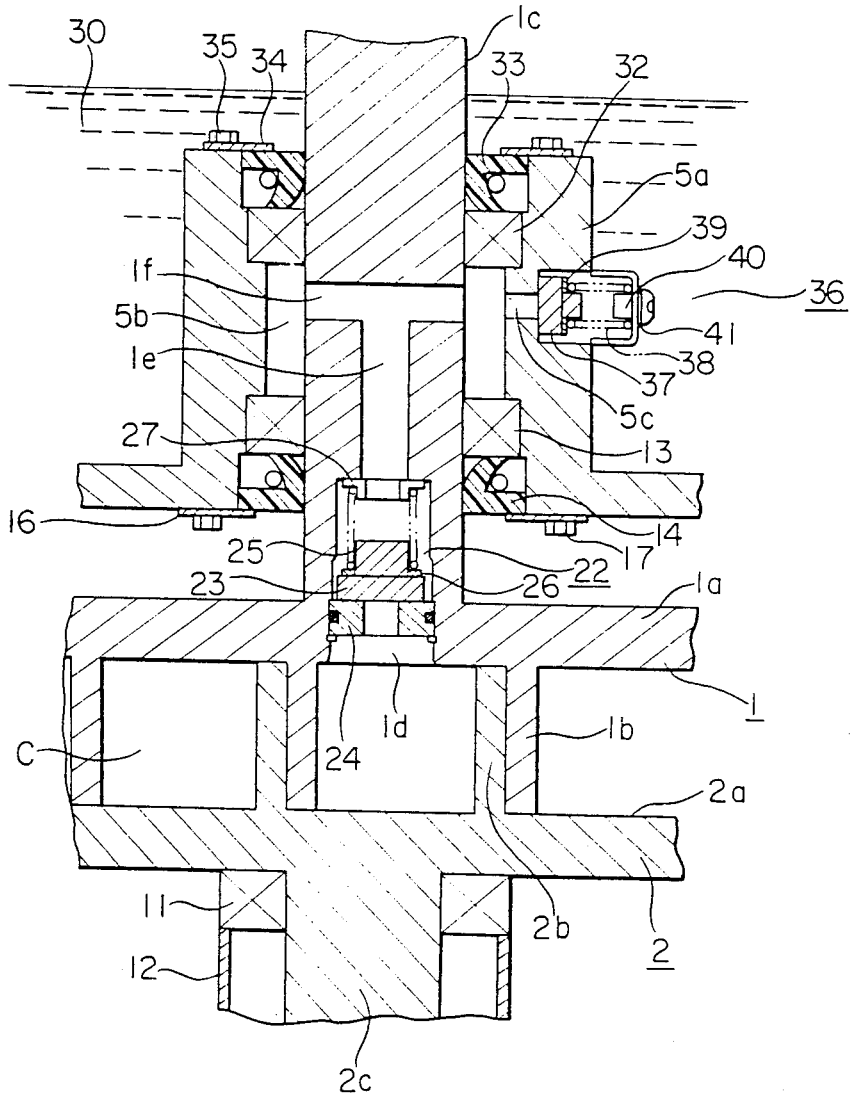
FIG. 4 is a vertical cross-sectional view of a portion of a section embodiment of the present invention which is equipped with two check valves on its discharge side.

FIG. 4 is a vertical cross-sectional view of the central portion of a second embodiment of the present invention which is equipped with two check valves for discharged gas instead of only one. As in the embodiment of FIG. 1, the drive shaft 1*c* of a drive scroll 1 extends upwards through a bearing housing 5*a* formed in the bottom portion of an upper housing 5. In contrast to the bearing housing 5*a* of FIG. 2, the bearing housing 5*a* of this embodiment extends above the radial discharge passageways if formed in the drive shaft 1*c*, and it supports a lower bearing 13 as well as an upper bearing 32. These bearings journal the drive shaft 1*c* and define the upper and lower ends of an annular cavity 5*b* onto which the radial discharge passageways if open. This cavity 5*b* is kept airtight by a lower spring-loaded packing 14 which is disposed below the lower bearing 13 and an upper spring-loaded packing 33 which is disposed above the upper bearing 32. The upper packing 33 is restrained from above by an annular restraining plate 34 which is secured to the top surface of the bearing housing 5*a* by bolts 35.

The bearing housing 5*a* has a discharge port 5*c* formed in its side. The inner end of the discharge port 5*c* opens onto the cavity 5*b* surrounding the drive shaft 1*c* while the outer end opens onto the outer surface of the bearing housing 5*a*. A check valve 36 is disposed in the outer end of the discharge port 5*c*. The check valve 36 has a hat-shaped slider 37 which reciprocates within the discharge port 5*c* and seats on a ledge formed within the discharge port 5*c*. The slider 37 is biased towards the ledge by a compression spring 38 which fits over the outer portion of the slider 37 and contacts a washer 39. The other end of the spring 38 fits over a cylindrical spring guide 40. The spring guide 40 is secured to a bracket 41 which is secured to the outer surface of the bearing housing 5*a*. The structure of this embodiment is otherwise the same as that of the embodiment of FIG. 1.

The operation of this embodiment is identical to that of the previous embodiment and provides the same advantages. Furthermore, the upper check valve 36 provides a further guarantee that gas which is discharged from the scrolls will not flow back and reenter the compression chambers. As a result, a high vacuum can be obtained.

Figure 5:
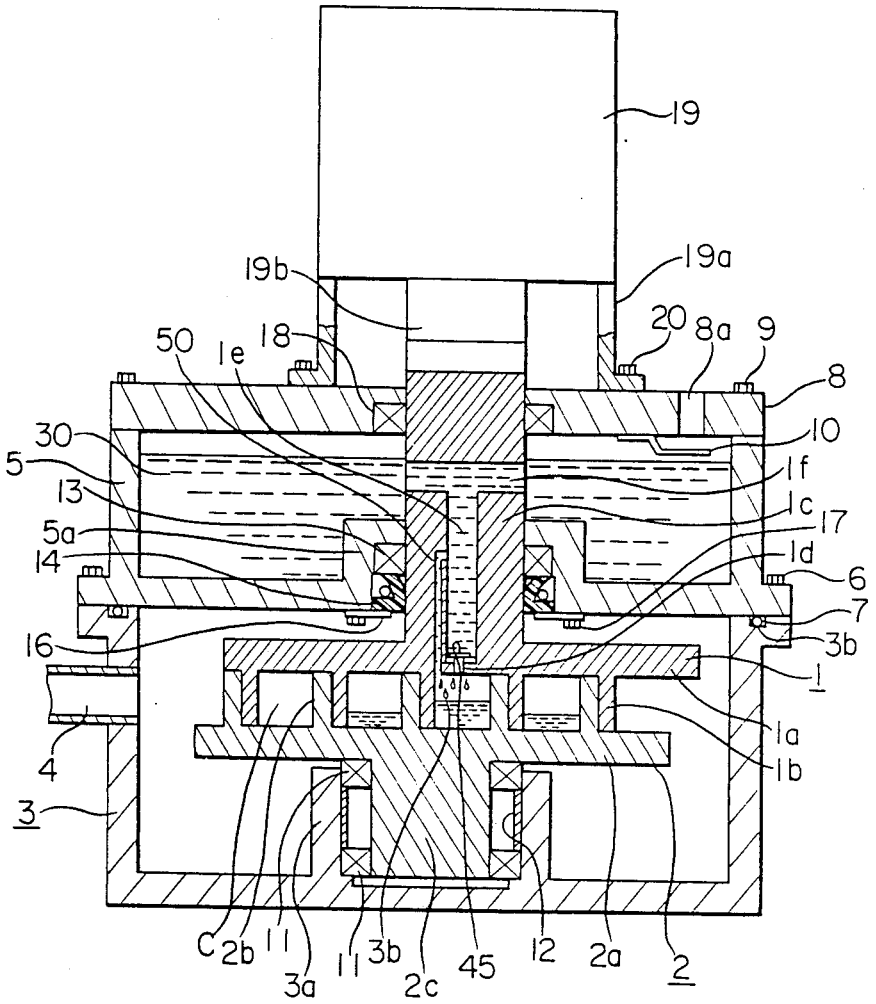
FIG. 5 is a vertical cross-sectional view of a third embodiment of the present invention.
Figure 6:
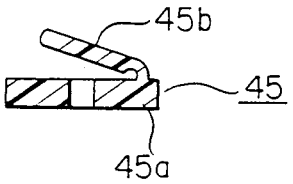
FIG. 6 is an enlarged vertical cross-sectional view of the check valve of the embodiment of FIG. 5.

FIG. 5 is a vertical cross-sectional view of a third embodiment of the present invention. The basic structure of this embodiment is similar to that of the embodiment of FIG. 1. However, instead of a spring-loaded check valve 22, a flapper-type check valve 45 is used to cover the discharge port 1*d* of a drive scroll 1. As shown in FIG. 6, which is an enlarged cross-sectional view, the check valve 45 has an annular body 45*a* and a flapper 45*b* which is hinged to and integral with the body 45*a*. The body 45*a* is secured to the bottom of an axial discharge passageway 1*e* formed in the drive shaft 1*c* of the drive scroll 1.

The drive shaft 1*c* is further equipped with an axially-extending oil supply passageway 50 which extends between the upper portion of the axial discharge passageway 1*e* and the lower surface of the end plate 1*a* of the drive scroll 1. The lower end of the oil supply passageway 50 opens onto one of the compression chambers C in the vicinity of the discharge port 1*d*. The structure is otherwise identical to that of the embodiment of FIG. 1.

During operation of this embodiment, the axial discharge passageway 1*e* is filled with lubricating oil 30. A portion of this oil 30 is introduced into one of the compression chambers C through the oil supply passageway 50. The oil 30 fills minute gaps between the spiral wraps themselves as well as between the spiral wraps and the end plates, thereby decreasing leaks between adjacent compression chambers and increasing the vacuum which is obtained by the pump. Furthermore, the oil 30 absorbs residual gas which remains in the compression chamber, and the residual gas is efficiently discharged from the scrolls together with the oil 30 through the check valve 45. This scavenging effect of the oil 30 enormously increases the degree of vacuum which can be produced by the pump. The operation is otherwise identical to that of the embodiment of FIG. 1. Although a flapper-type check valve 45 is used in this embodiment, a spring-loaded check valve of the type shown in FIG. 2 could be employed with the same effects.

Figure 7:
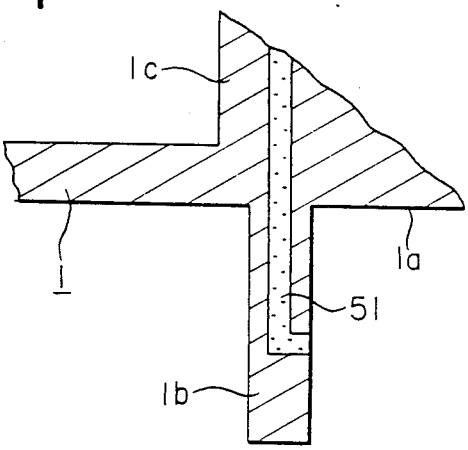
FIG. 7 is a vertical cross-sectional view of a portion of a drive scroll of a vacuum pump in accordance with the present invention, illustrating an alternate form of oil supply passageway.
Figure 8:
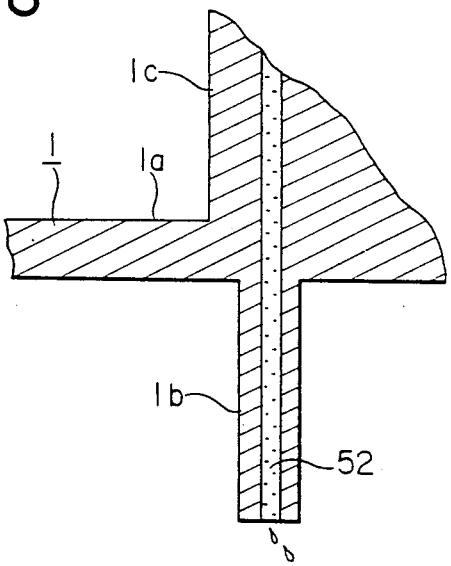
FIG. 8 is a vertical cross-sectional view of a portion of a drive scroll of a vacuum pump in accordance with the present invention, illustrating another form of oil supply passageway.

In FIG. 5, the oil supply passageway 50 opens onto the bottom surface of the end plate 1*a* of the drive scroll 1, but other arrangements are also possible. FIG. 7 illustrates a portion of a drive scroll 1 which has an oil supply passageway 51 which has a 90-degree bend near its lower end and which opens onto a compression chamber through the side of the spiral wrap 1*b* of the drive scroll 1. Another example of a drive scroll 1 is illustrated in FIG. 8, in which an oil supply passageway 52 opens onto the bottom surface of the spiral wrap 1*b* of the scroll.

In fact, there is no restriction on the shape of an oil supply passageway so long as it does not open onto a portion of the scrolls which communicates with the inside of the lower container 3. The oil which is introduced from the upper container 5 has been in contact with the atmosphere and contains air. If this oil were introduced into a space which communicated with the inside of the lower container 3, extremely the low pressure within the lower container 3 would cause the air to be released from the oil into the lower container 3, raising the pressure therein and counteracting the beneficial effects of the lubricating oil.

Figure 9:
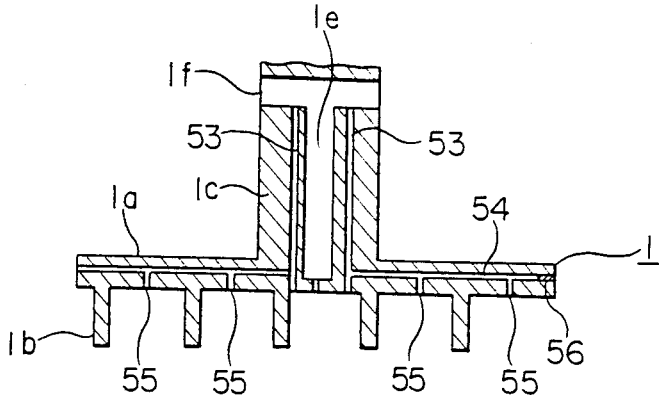
FIG. 9 is a vertical cross-sectional view of a portion of a drive scroll equipped with a plurality of oil supply passageways.
Figure 10:
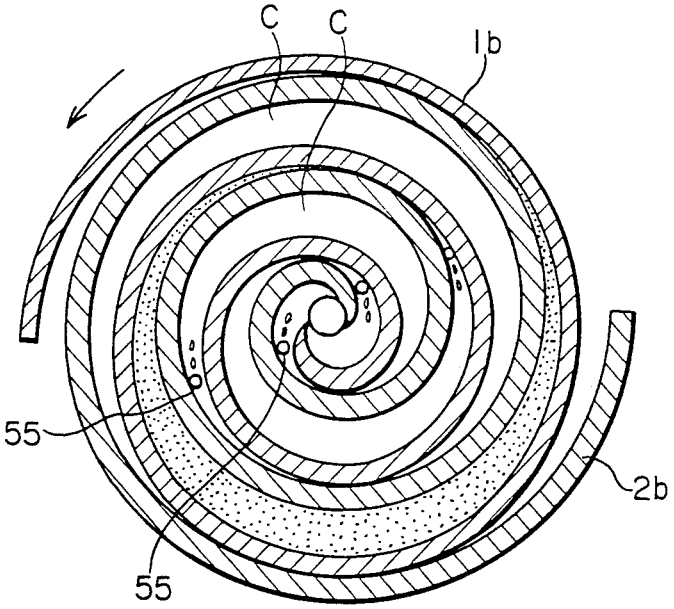
FIG. 10 is a horizontal cross-sectional view of the drive scroll of FIG. 9 and the driven scroll with which it interfits, illustrating the location of oil supply ports.

As shown in FIGS. 9 and 10, it is also possible to employ a plurality of oil supply passageways. FIG. 9 is a vertical cross-sectional view of a portion of a drive scroll 1 having a plurality of oil supply passageways, and FIG. 10 is a horizontal cross-sectional view of the spiral wrap 1*b* of the drive scroll 1 of FIG. 9 and the spiral wrap 2*b* of the driven scroll 2 with which the drive scroll 1 operates. The drive scroll 1 has two axially-extending oil supply passageways 53 formed therein on either side of an axial discharge passageway 1*e*. These oil supply passageways 53 extend between radial discharge passageways 1*f* and the lower surface of the end plate 1*a* of the drive scroll 1. Two radially-extending oil supply passageways 54 extend inside the end plate 1*a* between the axial oil supply passageways 53 and the outer peripheral surface of the end plate 1*a*. A plurality of oil supply ports 55 branch from the radial oil supply passageways 54 and open onto the bottom surface of the end plate 1*a* into each of the compression chambers C. The outer ends of the radial oil supply passageways 54 and the lower ends of the oil supply ports 55 which are not needed are sealed by stoppers 56. Symmetrically disposing a plurality of oil supply ports 55 about the discharge port 1*d* in this manner enables oil to be uniformly supplied to the compression chambers.

Figure 11:
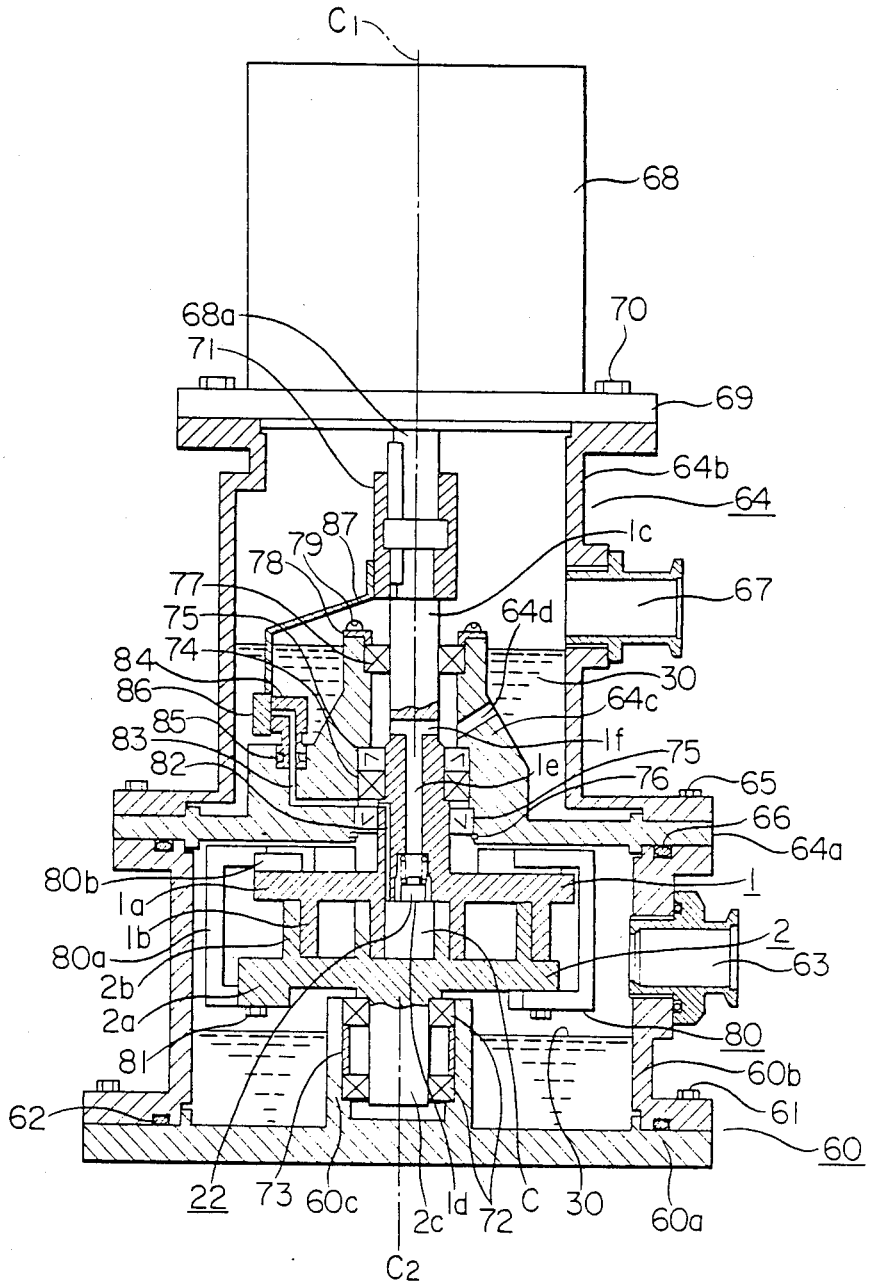
FIG. 11 is a vertical cross-sectional view of a fourth embodiment of a vacuum pump in accordance with the present invention.

FIG. 11 is a vertical cross-sectional view of a fourth embodiment of the present invention. Like the previous embodiments, it has a drive scroll 1 and a driven scroll 2 which are housed within a sealed lower container 60. The rotational axes C1 and C2 of the scrolls are parallel but nonaligned. The lower container 60 comprises a base 60*a* and a cylindrical upper portion 60*b* which is secured to the base 60*a* by bolts 61. An airtight seal between the base 60*a* and the upper portion 60*b* is obtained by an O-ring 62 which fits into a groove formed in the bottom surface of the upper portion 60*b* of the lower container 60. The base 60*a* has a bearing housing 60*c* formed on its top surface. The bearing housing 60*c* houses two bearings 72 which are separated from one another by a bearing spacer 73 and which journal the shaft 2*c* of the driven scroll 2. A suction port 63 which can be connected to an unillustrated vacuum chamber penetrates the wall of the upper portion 60*b* of the lower container 60. The lower container 60 is partially filled with lubricating oil 30.

The open upper end of the lower container 60 is covered by the flat base 64*a* of an upper container 64. The upper container 64 has a cylindrical upper portion 64*b* which sits atop the base 64*a* and is secured thereto by bolts 65 which pass through the base 64*a* and screw into the upper portion 60*b* of the lower container 60. An airtight seal between the base 64*a* of the upper container 64 and the upper portion 60*b* of the lower container 60 is formed by an O-ring 66 which fits into a groove formed in the upper portion 60*b* of the lower container 60.

A bearing housing 64*c* is formed on the upper surface of the base 64*a* of the upper container 64. The bearing housing 64*c* houses two bearings 74 and 77 which journal the upper end of the drive shaft 1*c* of the drive scroll 1. The lower bearing 74 is disposed between two spring-loaded packings 75. The lower of the two packings 75 is supported from below by a snap ring 76 which fits into a groove formed in the bearing housing 64*c*. The upper bearing 77 is restrained from above by an annular restraining plate 78 which is secured to the top surface of the bearing housing 64*c* by screws 79.

The outer ends of radial discharge passageways 1*f* which are formed in the drive shaft 1*c* open onto an annular cavity between the upper bearing 77 and the upper packing 75. A plurality of diagonal connecting holes 64*d* which are formed in the walls of the bearing housing 64*c* extend from this annular cavity to the outer surface of the bearing housing 64*c*.

A spring-loaded check valve 22 like that shown in FIG. 2 is disposed in the discharge port 1*d* of the drive scroll 1. Compressed gas which is discharged from the check valve 22 passes through an axial discharge passageway 1*e*, the radial discharge passageways 1*f*, and the diagonal connecting holes 64*d* and is discharged into the upper container 64. The upper container 64 is partially filled with lubricating oil 30 to a level above the connecting holes 64*d*.

An exhaust port 67 fits into a hole formed in the upper portion 64*a* of the upper container 64. The exhaust port 67 communicates with the atmosphere. The open upper end of the upper container 64 is covered by the base 69 of an electric motor 68. The motor base 69 is secured to the top surface of the upper container 64 by bolts 70. The motor 68 has an output shaft 68*a* which is connected to the drive shaft 1*c* of the drive scroll 1*a* by a coupling 71 so that the drive scroll 1 will rotate together with the motor 68.

The rotation of the drive scroll 1 is transmitted to the driven scroll 2 by a coupling 80. The coupling 80 has a plurality of arms 80*a* which are secured to the end plate 2*a* of the driven scroll 2 by bolts 81. The arms 80*a* extend upwards around both scrolls and slidingly engage with a plurality of keys 80b which are secured to the top surface of the end plate 1a of the drive scroll 1. This coupling 80 enables the scrolls to rotate in synchrony about nonaligned axes.

An axially-extending oil supply passageway 82 is formed in the drive shaft 1c of the drive scroll 1. The lower end of the oil supply passageway 82 opens onto the lower surface of the end plate 1a of the drive scroll 1 in the vicinity of a discharge port 1d. The upper end opens onto an annular cavity between the lower bearing 74 and the lower packing 75. An oil supply passageway 83 which is formed in the bearing housing 64c extends between this annular cavity and the outer surface of the bearing housing 64c. An elbow 84 having a passageway formed therein is inserted into the outer end of oil supply passageway 83 with the passageway in the elbow 84 aligned with oil supply passageway 83. The elbow 84 is disposed on the opposite side of the drive shaft 1c with respect to the exhaust port 67 and is submerged in lubricating oil 30. An O-ring 85 is inserted into a groove formed in the elbow 84 so as to prevent oil from entering the oil supply passageway 83 except through the passageway in the elbow 84. The outer end of the passageway in the elbow 84 is blocked by a plate 86 which is pressed against the face of the elbow 84 by a leaf spring 87, one end of which is connected to the plate 86 and the other end of which is connected to the coupling 71. The plate 86 and the leaf spring 87 together constitute an on-off valve for controlling the supply of lubricating oil to the compression chambers of the scrolls.

When the pump is not operating, the plate 86 is pressed firmly against the face of the elbow 84, and lubricating oil 30 is prevented from entering the oil supply passageways 82 and 83. However, when the drive shaft 1c is rotated by the drive motor 68, the plate 86 rotates together with the drive shaft 1c, and centrifugal force acting on the plate 86 causes it to swing outwards and away from the elbow against the force of the leaf spring 87, enabling oil 30 to enter the oil supply passageways 82 and 83 and flow into the compression chamber onto which oil supply passageway 82 opens. As in the previous embodiments, the oil helps to form an airtight seal between adjacent compression chambers and absorbs residual gas, thereby increasing the vacuum which can be produced by the pump. Before the lubricating oil 30 enters the oil passageway 82 in the drive shaft 1c, it accumulates in the annular cavity between the lower bearing 74 and the lower of the two packings 75. A portion of this oil lubricates the lower bearing 74. As the annular cavity is filled with oil, the oil can be reliably supplied to the oil supply passageway 82 regardless of the rotational position of the drive shaft 1c. The operation of this embodiment is otherwise the same as that of the embodiment of FIG. 1.

Other types of on-off valves can be used to open the oil supply passageways 82 and 83 when the pump is operating and close them when the pump is stopped, such as a cam-operated valve or a solenoid valve.

The degree of vacuum which can be produced by a scroll-type pump of the present invention is dependent on the rate at which lubricating oil is supplied to the compression chambers. The highest vacuum can be attained when the volume of oil q which is supplied to the central compression chamber of the pump per each revolution of the pump is approximately equal to the volume V of the central compression chamber. This condition can be attained by appropriately selecting the cross-sectional area of the oil supply passageway through which oil is introduced into the central compression chamber.

For example, in the case of a vacuum pump like the one illustrated in FIG. 5 which has a single oil supply passageway 50 with a circular cross-section, the rate Q is cubic meters per second at which oil enters the central compression chamber of the pump via the oil supply passageway 50 is given by the following well-known formula derived by Hagenbach for flow through a pipe.

$$Q = \frac{\pi r^4}{8\,\mu l} \cdot \Delta P \qquad (1)$$

wherein r=radius of oil supply passageway (m)
$\mu$=coefficient of viscosity of oil=$\rho \cdot \mu$ (kg/m×sec)
$\rho$=density of oil (kg/m$^3$)
$\nu$=kinematic viscosity of oil (m$^2$/sec)
l=length of oil supply passageway (m)
$\Delta$P=pressure difference (N/m$^2$)

If the rotational speed of the pump is N rps, then the amount of oil q in cubic meters which is supplied per revolution is equal to $$q = Q/N \ (m^3/\text{rev}) \qquad (2)$$

As stated above, the volume V of the central compression chamber should be approximately equal to q. Therefore, by combining Equations 1 and 2, the optimal radius r of the oil supply passageway 50 can be expressed as follows:

$$V = q = Q/N = \frac{\pi \cdot r^4 \cdot \Delta P}{8\mu \cdot l \cdot N}$$

$$r = \sqrt[4]{\frac{8\mu \cdot l \cdot N \cdot V}{\pi \cdot \Delta P}} \ (m) \qquad (3)$$

To test the accuracy of Equation 3, the present inventors used a number of vacuum pumps in accordance with the present invention to evacuate a vacuum chamber. The pumps all had a single oil supply passageway leading into the central compression chamber of the pump and were identical in structure except for the radius of the oil supply passageway, which was varied among the pumps. The operating conditions were as follows:

$\rho$=883 kg/m$^3$ at 20° C.
$\nu$=7.1×10$^{-5}$ m/sec
$\mu$=$\rho\nu$=6.3×10$^{-2}$ kg/m sec
$\Delta$P=1 atm. =1.033×9.8× $^4$ kg/m.sec$^2$
l=0.045m
N=30 rps (=1800 rpm)
V=0.47 cc/rev.

Figure 12:
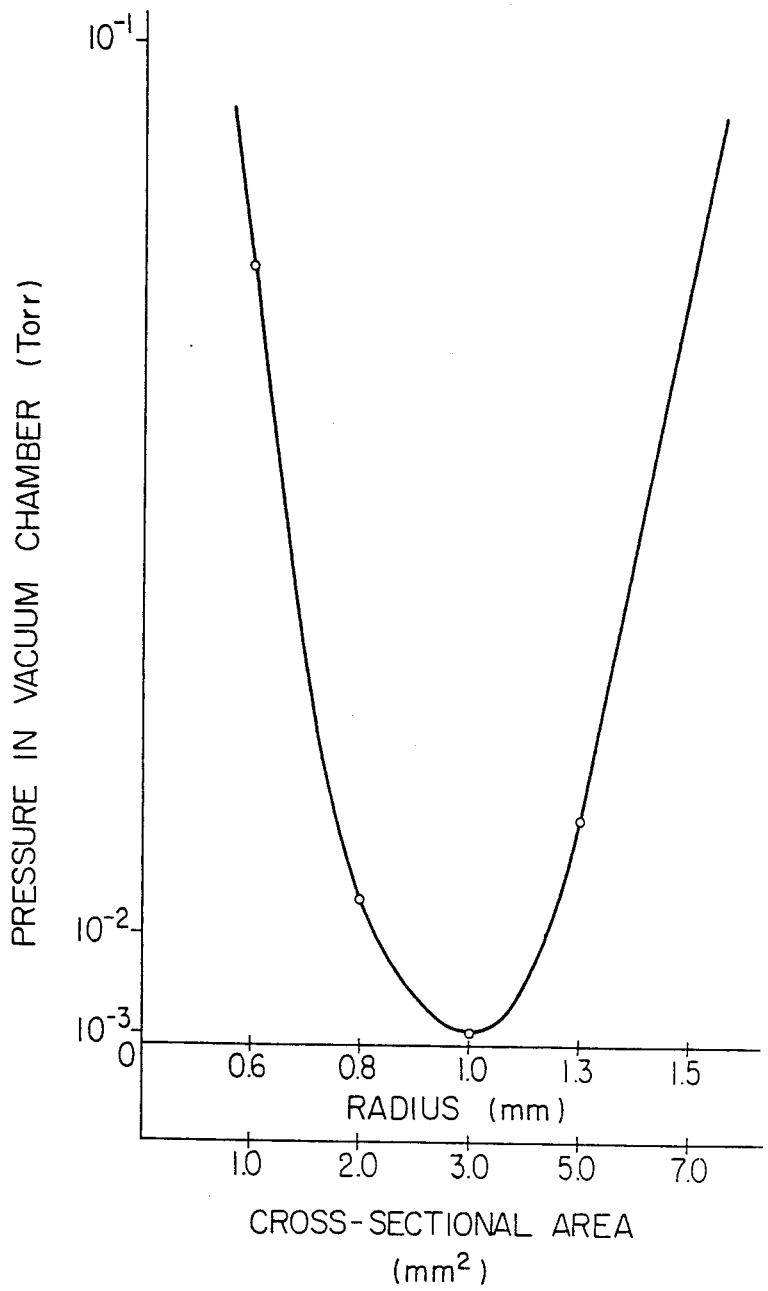
FIG. 12 is a graph of the pressure achieved in a vacuum chamber which was evacuated using a vacuum pump in accordance with the present invention as a function of the cross-sectional area and radius of a single oil supply passageway.

The results of measurements are shown in FIG. 12, in which the abscissa is the radius of the oil supply passageway and the ordinate is the pressure in the vacuum chamber. As can be seen from the figure, the highest vacuum was obtained when the radius of the oil supply passageway was 1 mm. This agrees with the theoretical optimal value of r given by Equation 3, which is also 1 mm.

In each of the above-described embodiments, the scrolls are disposed in a lower container and the gas which is compressed by the scrolls is discharged through the drive scroll into an upper container. However, it is instead possible for a discharge port and discharge passageway to be formed in the driven scroll instead of the drive scroll. In this case, the scrolls could be disposed in an upper container which communicates with a vacuum chamber, and the compressed gas could be discharged downwards through the driven scroll into a lower container which communicates with the atmosphere.

Furthermore, the axes of the scrolls are vertically disposed in each of the above embodiments, but it is also possible for the scrolls to be disposed with their axes horizontal. In this case, instead of having an upper and a lower container, a container which houses the scrolls and a container which communicates with the atmosphere would be disposed side by side.

What is claimed is:

1. A scroll-type fluid machine comprising:
- a first vessel which has a suction port;
- a second vessel which is hermetically connected to said first vessel, which has an exhaust port, and which is partially filled to a level with lubricating oil;
- a first scroll which is disposed in said first vessel and which has at its center a discharge port which communicates with the interior of said second vessel beneath the level of the oil;
- a second scroll which is combined with said first scroll so as to define at least one compression chamber;
- drive means for rotating at least one of said scrolls so that said compression chamber is moved from a position in which it communicates with said suction port to a position in which it communicates with said discharge port and which at the same time is decreased in volume; and
- a first check valve which blocks reverse flow through said discharge port.

2. A scroll-type fluid machine as claimed in claim 1, wherein said drive means comprises means for rotating both said first and second scrolls about parallel but nonaligned axes.

3. A scroll-type fluid machine as claimed in claim 1, further comprising a second check valve which is connected in series with said first check valve and which is disposed between said discharge port and the inside of said second vessel.

4. A scroll-type fluid machine as claimed in claim 1, wherein said first scroll has a shaft formed at its center which has a discharge passageway formed therein, said discharge passageway having an inner end which is connected to said discharge port and an outer end which communicates with the inside of said second vessel beneath the level of the oil.

5. A scroll-type fluid machine as claimed in claim 4, wherein said discharge passageway is filled with lubricating oil.

6. A scroll-type fluid machine as claimed in claim 4, further comprising a second check valve which is disposed at the outer end of said discharge passageway.

7. A scroll-type positive displacement apparatus comprising:
- a first container which communicates with a vacuum chamber which is to be evacuated;
- a second container which adjoins said first container and communicates with the atmosphere and is partially filled with oil;
- a first scroll which is disposed in said first container and comprises a flat, disk-shaped end plate, a spiral wrap which extends perpendicularly from one side of said end plate, and a shaft which extends perpendicularly from the opposite side of said end plate and extends into said second container, said first scroll having a discharge port formed at approximately the center of said end plate, said discharge port opening onto said one side of said end plate and communicating with the inside of said second container through the center of said shaft;
- a second scroll which is disposed in said first container and comprises a flat, disk-shaped end plate which is parallel to the end plate of said first scroll, a spiral wrap which extends perpendicularly from one side of the end plate of said second scroll, and a shaft which extends perpendicularly from the opposite side of the end plate of said second scroll and is parallel to but nonaligned with the shaft of said first scroll, said first scroll and said second scroll interfitting with one another so as to define a plurality of compression chambers, the outermost of which communicate with the inside of said first container and the innermost of which communicate with said discharge port;
- drive means for rotating said first and second scrolls in synchrony about their respective axes; and
- valve means for enabling compressed gas to flow through said discharge port from said scrolls into said second container but not in the opposite direction.

8. A scroll-type positive displacement apparatus as claimed in claim 1, wherein said valve means comprises a check valve which is disposed in said discharge port.

9. A scroll-type positive displacement apparatus as claimed in claim 1, wherein said valve means comprises a first check valve which is disposed in said discharge port and a second check valve which is connected in series with said first check valve and is disposed between said discharge port and the inside of said second container.

10. A scroll-type positive displacement apparatus as claimed in claim 1, wherein said drive means comprises:
- a motor which is connected to the shaft of one of said first and second scrolls so as to rotate said one scroll on its axis; and
- coupling means for transmitting the rotation of said one scroll to said other scroll.

* * * * *